United States Patent [19]

Huard

[11] Patent Number: 4,864,260

[45] Date of Patent: Sep. 5, 1989

[54] WAVEGUIDE CONNECTING DEVICE

[75] Inventor: Bertrand Huard, Ancienne-Lorette, Canada

[73] Assignee: Lab-Volt (Quebec) Ltd/Ltee, Quebec, Canada

[21] Appl. No.: 140,626

[22] Filed: Jan. 4, 1988

[51] Int. Cl.[4] ..... H01P 1/00

[52] U.S. Cl. ..... 333/255; 333/254; 439/920

[58] Field of Search ..... 333/254, 255, 248, 260; 439/920

[56] References Cited

U.S. PATENT DOCUMENTS

| | | | |
|---|---|---|---|
| 2,643,139 | 6/1953 | Hamilton | 333/255 |
| 2,738,207 | 3/1956 | Twigg Jr. | 333/255 |
| 3,076,159 | 1/1963 | Vaughan et al. | 333/255 |
| 3,315,186 | 4/1967 | Rosler et al. | 333/255 |
| 3,390,901 | 7/1968 | Bibb | 333/255 |
| 4,514,708 | 4/1985 | Ludtke | 333/255 |

FOREIGN PATENT DOCUMENTS

| | | | |
|---|---|---|---|
| 0148401 | 8/1984 | Japan | 333/254 |
| 0605348 | 7/1948 | United Kingdom | 332/255 |

*Primary Examiner*—William L. Sikes
*Assistant Examiner*—B. R. R. Holloway
*Attorney, Agent, or Firm*—Jones, Day, Reavis & Pogue

[57] ABSTRACT

The present invention relates to a clamping device for joining two waveguides used for propagating microwaves. The waveguides are of the type comprising hollow microwave propagation channels having at their meeting ends connection flanges in abutting relationship, the flanges being provided with aligned openings. The clamping device comprises a top wall and a pair of generally parallel side walls depending from the top wall. A metallic pin is mounted to one of the side walls and projects toward the other side wall which is provided with a cut-out portion facing the pin. In use, the pin is inserted through a pair of aligned openings in the flanges and the clamping device is pressed toward the flanges to turn about the axis of the pin until the flanges are deeply received between the side walls.

9 Claims, 4 Drawing Sheets

Fig. 1 (PRIOR ART)
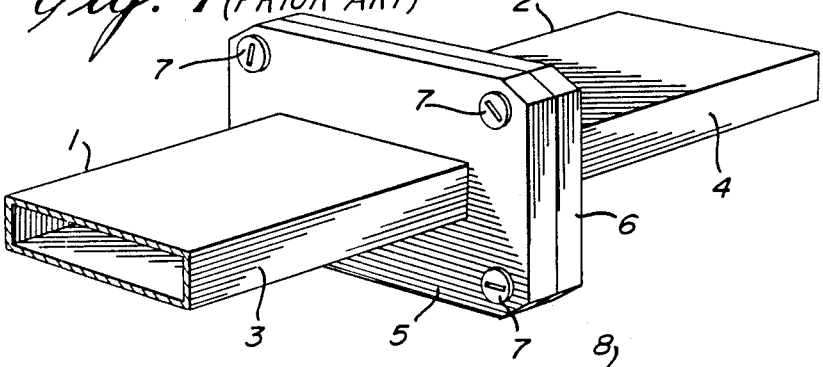
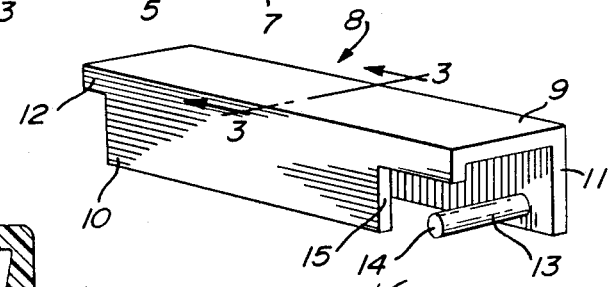
Fig. 2
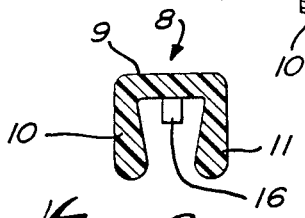
Fig. 3
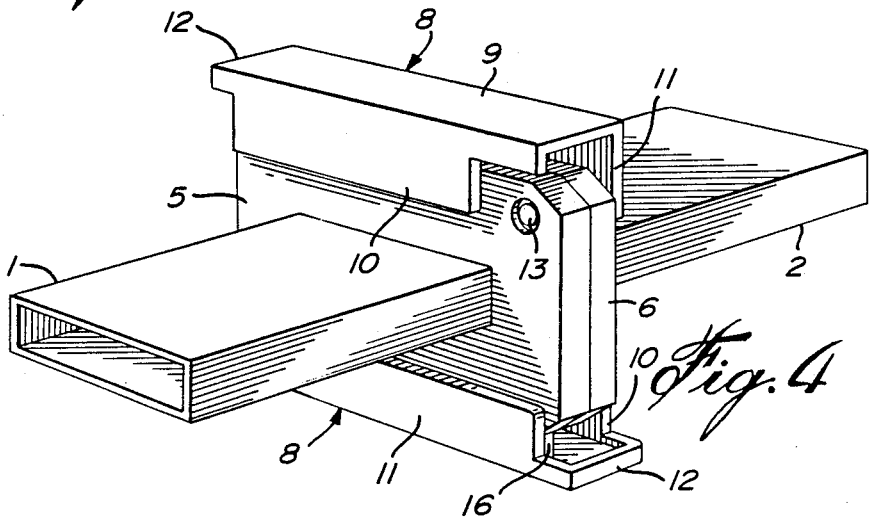
Fig. 4

WAVEGUIDE CONNECTING DEVICE

FIELD OF THE INVENTION

The present invention relates to the general field of fasteners and more particularly to a clip-like clamping device for connecting together two waveguides used for propagating electromagnetic radiation.

BACKGROUND OF THE INVENTION

Metallic waveguides are extensively used for channeling ultrahigh-frequency waves, the so called microwaves, in radio and television transmission, because of the low loss by attenuation and radiation. Typically, a waveguide is an elongated metallic pipe of circular or rectangular cross-section of such dimensions that it will propagate electromagnetic waves of a given frequency. Waveguides are manufactured in various lengths and sizes to suit different applications.

To construct a microwave device such as a receiver or an emitter, it is often necessary to connect together several waveguides. In practice, the waveguides are joined to each other with fasteners such as screws. This method of assembly is entirely satisfactory for a connection of permanent nature, however, it leaves much to be desired when only a temporary connection is necessary because the manipulation of screws is time consuming and requires tools. This problem is often encountered in school laboratories where, for performing student experimental work, waveguides are connected together for building a model to demonstrate a basic physical principle and immediately after the demonstration the model is deassembled. For the student benefit, it is desirable to reduce to a minimum the time required for assembling the demonstration model. However, with the currently available fasteners this is seldom achieved and it has been observed that students spent only a fraction of the laboratory period to study the physical phenomena, the rest of the time being spent for hardware assembly.

OBJECTS AND STATEMENT OF THE INVENTION

Therefore, the object of the present invention is an improved clamp allowing the user to rapidly and securely connect together two waveguides without the use of tools.

Another object of the ivention is an improved waveguide clamp which is of inexpensive construction and easy to manufacture.

The clamp, according to the invention, is adapted to be used with waveguides having meeting ends provided with flanges. The flanges are preferably of rectangular configuration with chamfered corners and comprise openings, at the corners thereof, provided for normally receiving screws to clamp two flanges together.

The clamp, according to the invention, obviates the use of such screws, yet, permits the user to securely connect the waveguides much more rapidly than by using screws and without the use of tools.

The clamp comprises a top wall and two depending side walls defining therebetween a space for receiving the flanges in abutting relationship. One of the side walls is slightly longer than the other and comprises a pin projecting toward the other side wall having a cut-out portion facing the pin.

To effect the connection of the waveguides with the clamp, the flanges of the waveguides are brought in abutting relation and the pin of the clamp is passed through a pair of aligned openings in the flanges. The clamp is then pressed on the flanges to pivot about the axis of the pin, until the flanges penetrate deeply between the side walls of the clamp.

Therefore, the present invention comprises in a general aspect a clamping device for connecting two guides for channeling electromagnetic radiation, the guides being of the type comprising each an elongated hollow body having at one end a connection flange provided with at least one opening. For connecting the guides the flanges thereof are brought in abutting relation wherein the openings on the flanges are aligned. The clamping device comprises (a) a top wall;

(b) a pair of side walls depending from the top wall; and (c) a pin mounted to one of the side walls and projecting toward the other of the side wall which is provided with a cut-out portion facing the pin, wherein to connect the guides, the pin is inserted through the openings of the flanges, the flanges being received between the side walls of the clamping device.

BRIEF DESCRIPTION OF THE DRAWINGS

FIG. 1 is a perspective view of two waveguides connected together by a conventional method;

FIG. 2 is a perspective view of a clamp according to the present invention;

FIG. 3 is a cross-sectional view taken along lines 3—3 of FIG. 2; and FIG. 4 is a perspective view of two waveguides connected together by two clamps according to the invention.

DESCRIPTION OF A PREFERRED EMBODIMENT

FIG. 1 of the annexed drawings illustrates two waveguides connected to each other in a conventional manner. The waveguides, identified by the reference numerals 1 and 2, respectively, comprise elongated microwave propagation channels 3 and 4, respectively, of rectangular cross-section, for channeling electromagnetic radiation.

To effect the connection of the waveguides 1 and 2, the channels 3 and 4 are provided at their meeting ends with flanges 5 and 6, respectively, each flange having a generally rectangular configuration with chamfered corners. The flanges 5 and 6 are in a plane perpendicular to the longitudinal axis of the channels 3 and 4.

At each corner of the flanges 5 and 6 are formed openings (not shown in the drawings) through which are inserted screws 7 to clamp the flanges together.

Considering that to construct a microwave device of average complexity, several such connections must be made, it becomes obvious that the time required to assemble the component parts of the device may be excessively long.

FIGS. 2 and 3 of the drawings illustrate a clamp according to the invention that allows the user to connect two waveguides of the type described above, without using any screws or other types of fasteners. The clamp identified by the reference numeral 8 comprises an elongated body made preferably of plastic material including a top wall 9 having two depending side walls 10 and 11, respectively. As best shown in FIG. 3, the thickness of the side walls 10 and 11 increases toward the lower ends thereof.

The top wall 9 projects forwardly, slightly beyond the vertical edges of the side walls 10 and 11, to form a tab 12 for facilitating the removal of the clamp 8 from the flanges 5 and 6.

From the inner face of the top wall 9 projects downwardly a stop member 16 having a circular cross-section.

A metallic pin 13 is mounted to the side wall 11 and projects toward the side wall 10. The pin 13 is circular in cross-section and has a beveled free end 14.

The side wall 10 comprises a cut-out portion 15 facing the pin 13. It is to be understood that, as used throughout this specification and in the appended claims, the phrase "cut-out portion" is intended to indicate merely the absence of a portion of side wall 10 opposite pin 13, without specifying the means by which said absent portion is provided. For example, it will be understood that portion 15 can be provided by physically cutting away a portion of side wall 10, by premolding side wall 10 to the desired shape, or by any conventional means known to those skilled in the art. As it will be explained in detail hereinafter, the purpose of the cutout portion 15 is to prevent an interference between the the side wall 10 and the flanges 5 and 6 during the installation of the clamp 8 on the flanges 5 and 6.

The body of the clamp 8 is preferably made of plastic material by a molding or an extrusion process which are well known in the industry and are well suited for a mass production. It should be evident, however, that other materials or other methods of production may be envisaged without departing from the spirit of the invention.

Reference is now made to FIG. 4 which illustrates the clamp 8 mounted to the flanges 5 and 6 for connecting the waveguides 1 and 2 together. To install the clamp 8, the latter is brought in a generally vertical position and the pin 13 is inserted through a pair of aligned openings of the flanges 5 and 6. The cut-out portion 15 permits the side wall 10 to stay clear of the flanges 5 and 6 allowing the pin to be inserted in the openings until the outer face of the flange 6 contacts the inner face of the side wall 11. Then, the clamp 8 is pressed down to pivot about the axis of the pin 13 until the flanges 5 and 6 penetrate deeply between the side walls 10 and 11 and the stop member 16 abuts on top of the flanges 5 and 6.

The increased thickness of the side walls at their base portions provides a spacing therebetween which is slightly less than the combined thickness of the flanges 5 and 6 in abutting relation. Therefore, during the installation of the clamp 8 some force must be applied on the top wall 9 thereof, permitting the side walls 10 and 11 to flex laterally to accommodate the flanges 5 and 6 therebetween.

The clamping force exerted by the clamp 8 may be changed by varying the resiliency of the side walls 10 and 11 either by changing the composition of the plastic material used for the manufacture of the clamp 8 or, by changing the thickness of the side walls 10 and 11.

Preferably, to securely connect the waveguides 1 and 2 to each other, two clamps should be used, as shown in FIG. 4. Although, one clamp may eventually be sufficient, two clamps ensure a good alignment between the microwave propagation channels 3 and 4, thus, helping to reduce undesirable microwave reflections susceptible to occur at the junction between the flanges 5 and 6 especially if the waveguides 1 and 2 are misaligned.

Although the invention has been described above with respect to one specific form, it will be evident to persons skilled in the art that it may be refined and modified in various ways. It is therefore wished to have it understood that the present invention should not be limited in interpretation except by the terms of the following claims.

I claim:

1. A clamping device for connecting two waveguides for channeling electromagnetic radiation, each said waveguide comprising an elongated hollow body having at one end a connection flange comprising an opening, such that when said waveguides are connected the flanges thereof are brought in abutting relation wherein the openings on the flanges are aligned, said clamping device comprising:

(a) a top wall;

(b) a pair of side walls depending from said top wall, said side walls facing each other;

(c) a pin mounted to one of said walls and projecting toward the other of said side walls which is provided with a cut-out portion facing said pin, wherein to connect said guides said pin being inserted through the openings of said flanges and said flanges being received between said side walls.

2. A clamping device as defined in claim 1, further comprising a stop member mounted to the underside of said top wall.

3. A clamping device as defined in claim 1, wherein said side walls are thicker at the ends thereof further from said top wall than at the ends thereof adjacent said top wall.

4. A clamping device as defined in claim 1, further comprising a tab mounted to said top wall to facilitate removal of said clamping device from said flanges.

5. A clamping device as defined in claim 1, wherein said top wall and said side walls are made of plastic material.

6. A clamping device as defined in claim 1, wherein said pin is made of metallic material.

7. A clamping device as defined in claim 1 wherein said pin has a free end which is beveled.

8. A waveguide, comprising:

first and second elements for channeling electromagnetic radiation, each element including an elongated hollow body having at one end a connecting flange provided with at least two spaced apart openings, the flanges of said first and second elements being in abutting relation; and connecting means for connecting said flanges to each other, said connecting means including a pair of clamps, each clamp comprising:

(a) a top wall;

(b) a pair of side walls depending from said top wall, said side walls being spaced apart from each other; and (c) a pin mounted to one of said side walls and projecting toward the other of said side walls which has a cut-out portion facing said pin, the pin of each clamp being mounted into a respective pair of aligned openings in said flanges and said flanges being received between the side walls of the clamp.

9. A waveguide comprising:

first and second elements for channeling electormagnetic radiation, each element including an elongated hollow body having at one end a connecting flange provided with at least one spaced apart opening, the flanges of said first and second elements being in abutting relation; and connecting means for connecting said flanges to each other, said connecting means including a clamp comprising:

(a) a top wall;

(b) a pair of side walls depending from said top wall, said side walls being spaced apart from each other; and (c) a pin mounted to one of said side walls and projecting toward the other of said side walls which has a cut-out portion facing said pin, the pin of the clamp being mounted into a respective pair of aligned openings in said flanges and said flanges being received between the side walls of the clamp.

* * * * *